United States Patent [19]

Davidson

[11] 4,344,265

[45] Aug. 17, 1982

[54] ENERGY CONSERVING BUILDING STRUCTURAL ELEMENTS NORMALLY CALLED WINDOW OR DOOR FRAMES

[76] Inventor: James D. Davidson, P.O. Box 1293, Pontiac, Mich. 48056

[21] Appl. No.: 168,594

[22] Filed: Jul. 14, 1980

[51] Int. Cl.[3] ..... E02D 35/00

[52] U.S. Cl. ..... 52/741; 52/127.1; 52/404; 52/213; 52/99; 52/214

[58] Field of Search ..... 52/127, 204, 741, 404, 52/403, 232, 213, 98, 99, 730, 210, 214

[56] References Cited

U.S. PATENT DOCUMENTS

| | | | |
|---|---|---|---|
| 4,144,688 | 3/1979 | Dixon | 52/232 |
| 4,204,373 | 5/1980 | Davidson | 52/204 |
| 4,224,774 | 9/1980 | Petersen | 52/730 |

*Primary Examiner*—Carl D. Friedman

[57] ABSTRACT

This invention relates to energy conserving structural elements, commonly called window or door frames with outer framing being adapted to be installed in building wall rough openings, said framing has a strip of compressible expandable thermal insulation fastened in a recess in said framing and an enveloping means maintains said thermal insulation in a compressed state until said structural element is installed in said building wall, said enveloping means is of tearable material that can be rendered inoperative allowing said thermal insulation to expand and fill said air gap, reducing heat transfer either direction through said air gap.

This invention relates to all objects constructed to be inserted into other objects creating an air gap that should be sealed and thermally insulated.

6 Claims, 7 Drawing Figures

ENERGY CONSERVING BUILDING STRUCTURAL ELEMENTS NORMALLY CALLED WINDOW OR DOOR FRAMES

| Cross References to related application | | |
|---|---|---|
| | Filing Date | Title |
| U.S. Pat. No. 4,204,373 | Sept. 8-1978 | Compressed expandable insulation tape. |
| application Ser. No. 849,000 | Nov. 7-1977 | Energy and cost savings construction method. |

BACKGROUND OF INVENTION

1. Field of Invention:

This invention is a means to thermally insulate air gaps found around window frames, door frames and other structural frames which will be referred to as structural elements throughout this application, said field of invention is building construction such as dwellings and the like.

2. Description of Prior Art

The prior art is almost non-existing, applicant finds very little is actually done in the field to solve this problem, when anything is done they take a blunt tool and stuff fiber glass into the air gap around windows and door frames, stuffing packs said insulation defeating the purpose of the insulation, one could buy a can of spray foam which is very expensive and messy to spray into said air gap which usually is at least one half inch wide, most builders do not want this material used unless used by a expert which cost from $15.00 to $24.00 per hour, said foam material will melt from suns ray's and disappear into the atmosphere if not quickly covered.

SUMMARY OF INVENTION

This invention relates generally to structural elements used in building walls normally called window frames, or door frames, said elements being installed into a rough opening formed by the structural framing components of said building wall, said elements comprising an outer frame adapted to be inserted in said rough opening with sufficient clearance to leave a relatively narrow air gap which should be insulated, said element having a strip of compressed expandable thermal insulation recessed in said outer periphery frame with enveloping means maintaining said insulation in a compressed state until said structural element is inserted in said rough opening in said building wall, said enveloping means being tearable so as to be capable of being rendered inoperative allowing said compressed expandable thermal insulation to expand and substantially fill said air gap with thermal insulation reducing heat transfer either direction through said air gaps found around structural elements, normally called windows or door frames.

The main object of this invention is to reduce heat transfer either direction through air gaps found around structural elements such as window and door frames, another object is to standardize the method of thermally insulating said air gaps, another object is to eliminate stuffing insulation in air gaps with blunt objects which packs the insulation reducing the effectiveness of said insulation, another and important object is to install energy conservation structural elements such as window or door frames or the like, which has a strip of compressed expandable thermal insulation recessed in said frame enveloped in a compressed state, said structural element being installed in a building wall in combination with thermally insulated construction lumber components forming a rough opening, said rough opening components comprised of thermally insulated wall studs, header support studs, window or door headers or the like, said thermally insulated components are comprised of a layer of hard board thermal insulation sandwiched therebetween construction lumber, said rough opening components in combination with said energy conservation structural element with said compressed expandable thermal insulation being in a expanded state defining a thermally insulated air gap filled with thermal insulation, improving the over all energy conservation of said wall by reducing heat transfer through the building wall components and the air gap found around the structural elements, for further detail on insulated wall components see prior art application Ser. No. 849,000 filed by applicant, still another object is to invent an energy conservation structural element with said compressed expandable thermal insulation installed in a recess in the outer periphery frame of said structural element, said thermal insulation being installed at the factory on a mass production basis thereby lowering the cost at the job site eliminating lost time now wasted when and if a builder decides to insulate said air gaps found around said structural elements, applicant believes this invention will standardize the way of properly insulating said air gaps with an inexpensive means that will be accepted within the art of building construction.

Lastly a further object is to establish a easy method for the manufacturer of windows, doors or other structural frames to install said compressible expandable thermal insulation onto said structural element on a mass production basis, said method comprises a enveloping means which is of tearable material which maintains said thermal insulation in a compressed state and with a fastening means to said structural element which could be metal fastener or adhesives or both.

Said structural element frame component with said pre-formed recess in said frame could be manually pushed through a roller system applying said enveloping material to said element frame simultaneously compressing said insulation and applying said enveloping material, still another method might be to manually compress said insulation and fasten said enveloping means with metal fasteners which are applied with common hand tools now used in the arts, either method or any similar method would allow mass production to be used to reduce cost of adding said compressed expandable thermal insulation to said structural elements which will conserve enough energy to more than offset said production cost.

DESCRIPTION OF THE PREFERRED EMBODIMENTS

Figure 2:
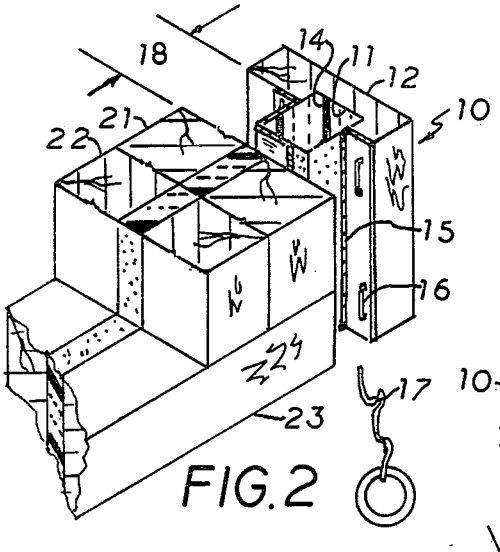
FIG. 2 is the same as lower section of FIG. 1 only with thermal insulation expanded filling said air gap.

Reference is now made in greater detail to the drawings, which are illustrative only, and wherein like elements are designated by the same reference numerals.

Figure 1:
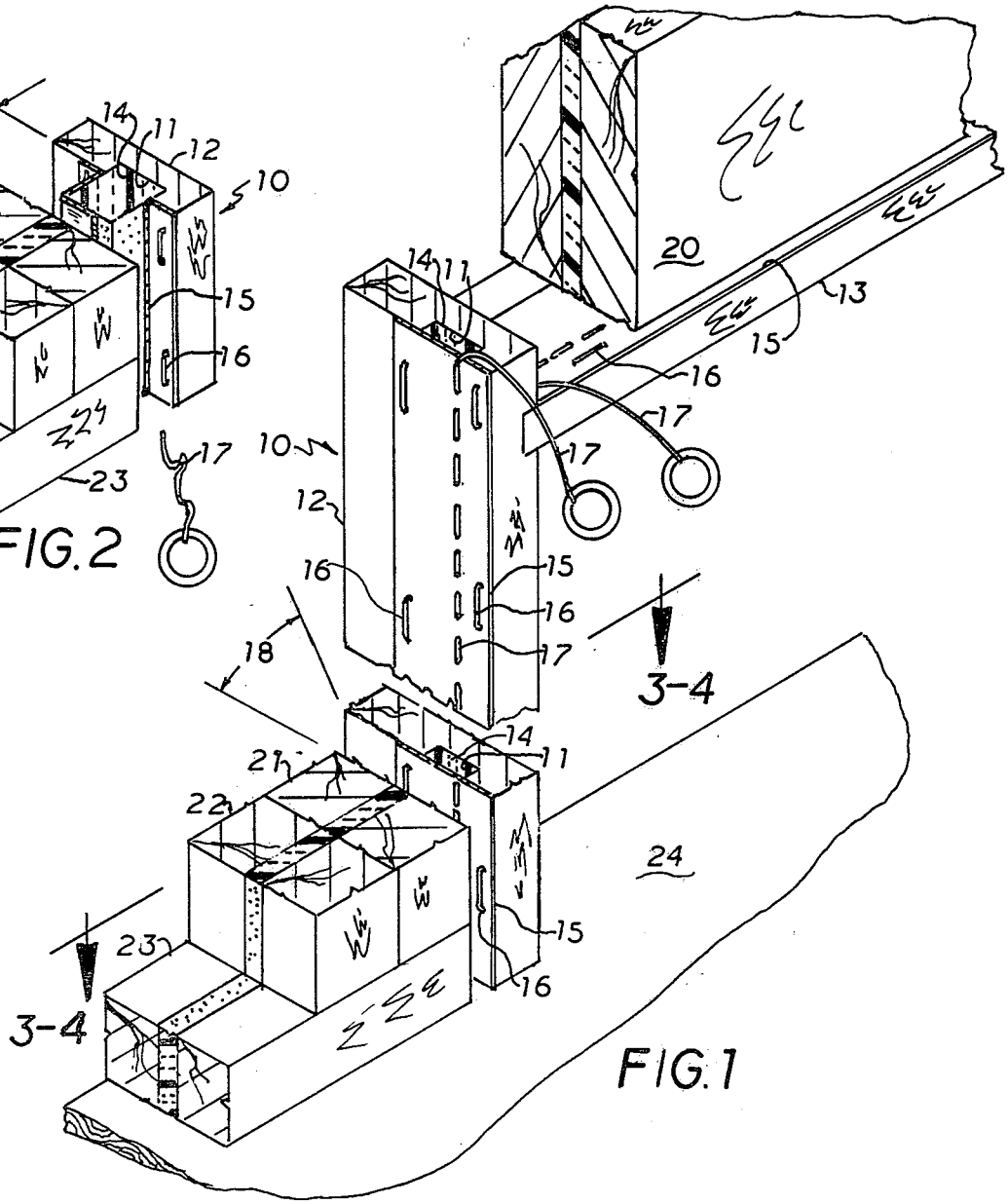
FIG. 1 is a pictorial view of a typical door frame with compressed expandable thermal insulation, with enveloping means to maintain said insulation in a compressed state, installed in a wall showing the header support studs and header.

FIG. 1 is a pictorial view of a structural element 10 commonly called a door frame, said element 10 is encompassed by a thermally insulated door header 20, header support stud 21, further shown is wall stud 22 and sole plate 23 setting on sub-floor 24, structural element 10 has a recess 11 running longitudinally end to end through the framing jamb 12 and header jamb 13, said recess 11 is filled with compressed expandable thermal insulation 14, maintained in a compressed state by enveloping means 15 held fastened to jamb 12 and jamb 13 with fastening means 16 which could be metal fastener or adhesives or the like, said enveloping means 15 can be any tearable material that can be rendered inoperative by rendering means 17 allowing said compressed thermal insulation 14 to expand filling said air gap 18 with thermal insulation reducing heat transfer either direction through said air gap 18.

Structural element 10 as shown is made from wood but could be metal or plastic or a combination of all three.

The mode of operation is placing said structural element 10 into a wall rough opening formed by header support stud 21 and header 20 which defines air gap 18, said structural element is first leveled in rough opening and enveloping rendering means 17 is manually pulled loose from enveloping means 15 tearing said enveloping means 15 allowing said thermal insulation 14 to expand filling air gap 18 whereby heat transfer is reduced either direction through said air gap 18.

Should be noted the inside drywall has not been shown or the structural element trim so as to simplify the drawing, the same applies for outside wall sheathing and wall covering such as wood siding or the like.

FIG. 2 is a pictoral view the same as the lower part of FIG. 1 showing thermally insulated wall stud, header stud 21 with structural element 10 installed showing jamb 12 in place, rendering means 17 has been pulled tearing enveloping means 15 allowing said thermal insulation 14 to expand and fill air gap 18, FIGS. 1 and 2 both show a structural element 10 which is a door frame but could just as well be a structural element commonly called a window or the like.

Figure 3:
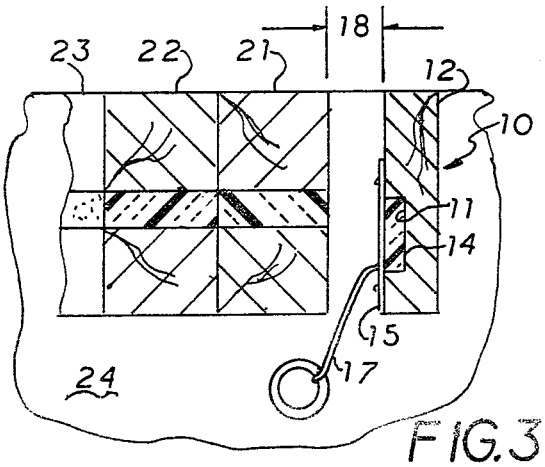
FIG. 3 is a plan view of lower section of FIG. 1 shown in direction of arrow 3—3.

FIG. 3 is a plan view taken on line 3—3 FIG. 1 showing jamb 12 and header stud 21 defining air gap 18, thermal insulation 14 is in a compressed state maintained by enveloping means 15 fastened to jamb 12 with fastening means 16, rendering means 17 has not been manually pulled therefore said air gap is shown uninsulated.

Figure 4:
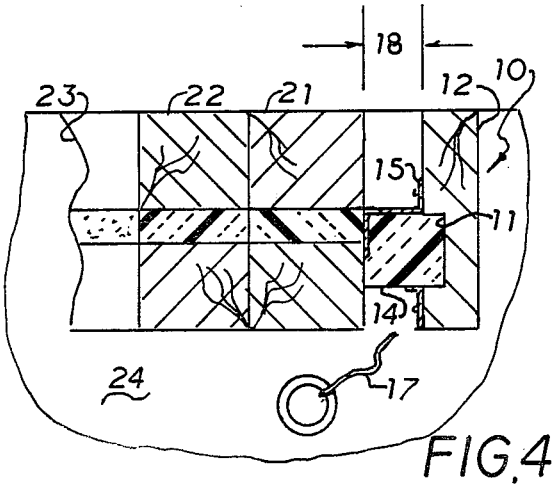
FIG. 4 is a plan view of lower section of FIG. 1 same as FIG. 3 except enveloping means has been rendered inoperative allowing said insulation to expand from said recess in door frame expanding to fill said air gap, this plan view is taken on line 4—4 FIG. 1.

FIG. 4 is the same as FIG. 3 but taken on line 4-4 FIG. 1 but rendering means 17 has been pulled tearing enveloping means 15 allowing thermal insulation 14 to expand and fill air gap 18 defining a thermally insulated air gap.

Figure 5:
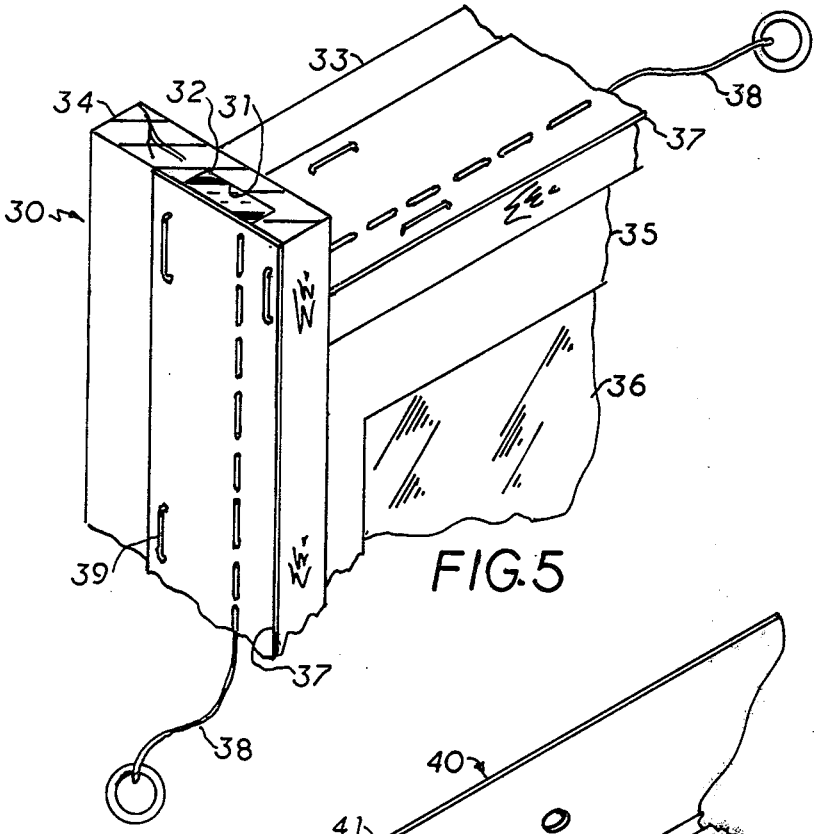
FIG. 5 is a typical pictorial view of a wood window frame with compressed expandable thermal insulation enveloping means installed compressing said insulation.

FIG. 5 is a pictoral view of a structural element 30 commonly called a wood window comprised of a side jamb 34, header jamb 33 with a recess 31 running longitudinally end to end of each jamb 34 and 33 further totally encompassing said outer frame of said element 30 which is not shown in this pictoral view, further shown is glass 36 and holding frame 35, enveloping means 37 is fastened to said element 30 with fastening means 39 and rendering means 38 has not been pulled therefore thermal insulation 32 is in a compressed state in recess 31, structural element 30 is ready to be installed in a rough opening in a building wall which is not shown in this view.

Figure 6:
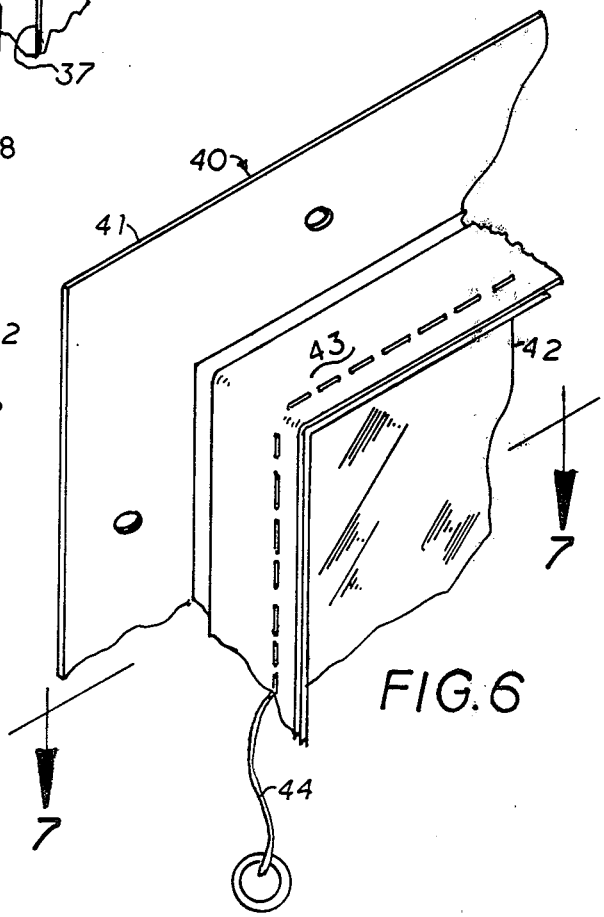
FIG. 6 is a pictorial view of a window with a metal or plastic frame with compressed expandable thermal insulation maintained in a compressed state by enveloping means.

FIG. 6 is a pictoral view of a structural element 40 commonly called a metal or plastic frame window showing frame 41 with glass 42 installed, further shown is enveloping means 43 which has compressed the compressible expandable thermal insulation (not shown), rendering means 44 is shown but not pulled therefore said structural element 40 is ready to be installed in a building wall rough opening which is not shown.

Figure 7:
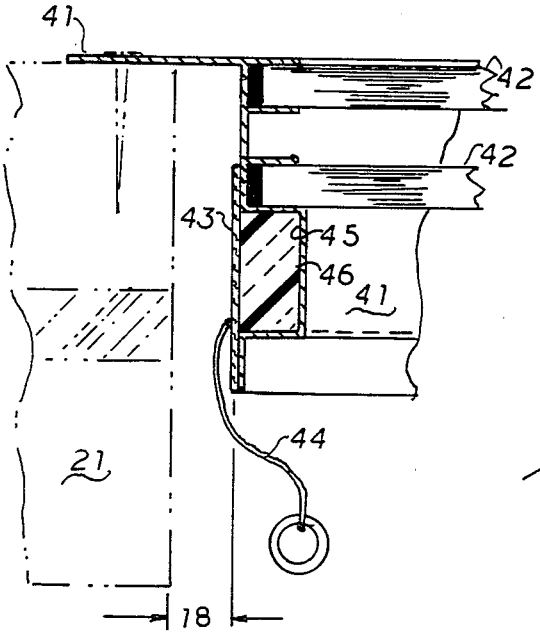
FIG. 7 is a section taken on line 7—7 from view 6 showing how frame is recessed and compressed expandable thermal insulation is maintained in a compressed state.

FIG. 7 is a view taken on line 7—7 FIG. 6 which shows said structural element 40 installed in a rough opening formed by thermal insulated header support stud 46 defining air gap 18, said structural element 40 has a recess 45 completely encompassing said frame 41 with compressed compressible expandable thermal insulation 46 which is maintained in a compressed state by enveloping means 43 which is a tearable material that can be rendered inoperative by rendering means 44.

The above specifications clearly disclose said invention; hence I do not wish to be understood as limiting myself to the exact form, construction, arrangement and combination of parts herein shown and described or uses mentioned.

I claim:

1. An improved energy conserving structural element normally used in combination with other structural components in a manner such that a relatively narrow air gap that should be thermally insulated is created between elements, said element comprising a structural member having thermal insulation means secured thereon the side therefore that will define the air gap, said insulation means comprising compressed expandable thermal insulation means having enveloping means retaining same in a compressed state, said enveloping retaining means being capable of being rendered inoperative so as to allow said insulation material to expand, said insulation material in its expanded state, having thickness to substantially fill said air gap, wherein the improvement comprises:

means for recessing and enveloping said compressible expandable insulation into said structural elements outer periphery surface, said recess being used to substantially provide said envelope means;

means for maintaining said compressible expandable insulation in a compressed mode in said recess enveloping means; and until said maintaining means is rendered inoperative.

2. An improved energy conserving structural element as recited in claim 1, wherein said structural element is a window frame.

3. An improved energy conserving structural element as recited in claim 1 wherein said structural element is a door frame.

4. An improved energy conserving structural element as recited in claim 1, comprised of a thermal insulation means having a means of enveloping said thermal insulation in a compressed mode in a recess located in the outer periphery of said structural element, wherein the improvement comprises:

metal fasteners being used to fasten said enveloping means to said structural element.

5. An improved energy conserving structural element as recited in claim 1, comprised of a thermal insulation means having a means of enveloping said thermal insulation in a compressed mode in a recess located on the outer periphery of said structural element, wherein the improvement comprises:

adhesive being used to fasten said enveloping means to said structural element.

6. A method for reducing heat transfer either direction through building wall structural components used to construct walls and form rough openings for structural elements such as door and window frames, wherein the method steps are as follows:

construct a building wall using insulated construction lumber;

forming the rough openings for energy conserving structural elements such as window and door frames;

envelope compressed thermal insulation into a recess means provided in said structural elements outer periphery surface;

install said structural element in said formed wall rough opening; and render said thermal insulations enveloping means inoperatable allowing said compressed thermal insulation to expand and substantually fill the air gap found between the wall rough opening components and the structural element; thereby improving the overall reduction of heat transfer through said building wall.

* * * * *